US006293328B1

(12) United States Patent
Fremont

(10) Patent No.: US 6,293,328 B1
(45) Date of Patent: Sep. 25, 2001

(54) PORTABLE SCREEN

(76) Inventor: Donna A. Fremont, 557 Newton Rd., Port Orange, FL (US) 32127

( * ) Notice: Subject to any disclaimer, the term of this patent is extended or adjusted under 35 U.S.C. 154(b) by 0 days.

(21) Appl. No.: 09/631,429

(22) Filed: Aug. 3, 2000

(51) Int. Cl.[7] ..... A47G 5/00
(52) U.S. Cl. ..... 160/135; 52/36.4
(58) Field of Search ..... 160/135, 351; 52/239, 36.4, 36.5

(56) References Cited

U.S. PATENT DOCUMENTS

| | | | |
|---|---|---|---|
| D. 333,706 | | 3/1993 | Hachkowski . |
| 3,224,489 | * | 12/1965 | Haberthier . |
| 3,592,289 | * | 7/1971 | Aysta . |
| 4,030,219 | | 6/1977 | Donovan . |
| 4,043,086 | * | 8/1977 | Kaulfuss et al. . |
| 4,375,829 | * | 3/1983 | Dorr et al. . |
| 4,722,146 | * | 2/1988 | Kemeny . |
| 4,874,027 | * | 10/1989 | Boundy et al. . |
| 4,926,609 | | 5/1990 | Arico . |
| 4,928,465 | | 5/1990 | Del Castillo Von Haucke . |
| 4,981,152 | | 1/1991 | Laurent . |
| 5,007,473 | | 4/1991 | Evensen . |
| 5,054,507 | | 10/1991 | Sparks . |
| 5,287,909 | | 2/1994 | King et al. . |
| 5,291,700 | | 3/1994 | Chew . |
| 5,486,391 | | 1/1996 | Tyner . |
| 5,520,477 | | 5/1996 | Fink . |
| 5,544,389 | | 8/1996 | Roberts . |
| 5,680,893 | | 10/1997 | Neer . |
| 5,775,034 | | 7/1998 | Logue . |
| 5,778,959 | | 7/1998 | Guetschow . |
| 5,803,146 | * | 9/1998 | Boon . |
| 5,881,789 | | 3/1999 | Melashenko et al. . |
| 6,116,326 | * | 9/2000 | Domina et al. . |

FOREIGN PATENT DOCUMENTS

| | | |
|---|---|---|
| 2199743 | 7/1988 | (GB) . |
| 2218631 | 11/1989 | (GB) . |

* cited by examiner

*Primary Examiner*—Blair M. Johnson
(74) *Attorney, Agent, or Firm*—Richard C. Litman

(57) ABSTRACT

A portable privacy screen is provided, which enables a user to quickly and easily create a zone of personal space where cosmetics may be applied, clothes put on and adjusted, and changes and improvements in appearance made. The screen is constructed from a plurality of individual, smaller panels and is foldable into a compact and easily carried configuration. The screen may also have a mirror and can carry advertising messages or other printing. The portable screen is arranged in the general form of a triptych, preferably including an upper and a lower array of panels. Each individual array is also in the general form of a triptych. A carrying bag, which is dimensioned to snugly contain the portable screen in disassembled form and itself is sufficiently configured to be carried over the shoulder of a user like a duffle bag, is also provided. The lower array, is reversibly interconnected to the upper array and is held in spaced-apart relation therefrom. The privacy screen further includes at least one preferably battery powered fluorescent light removably attached by hook and loop fastener to the front surface of the central upper panel, at least one mirror, and support members for hanging various articles such as clothes therefrom.

18 Claims, 3 Drawing Sheets

PORTABLE SCREEN

BACKGROUND OF THE INVENTION

1. Field of the Invention

The present invention relates generally to modular stations. More specifically, the invention is a lightweight portable privacy screen.

2. Description of Related Art

Over the years, numerous screens for increasing privacy or separating a user from a larger, more public area have been devised. Some of the most significant advances have involved screens having multiple free-standing sections. However, none of the references herein described presents a portable screen, which allows a user to set up a complete dressing station at almost any location. For example, U.S. Pat. No. 4,030,219, issued to Donovan, discloses a portable display apparatus comprised of a plurality of rectangular skeletal frames. Each rectangular skeletal frame includes a horizontal hinge, adapted to enable the frame to fold vertically. Each rectangular skeletal frame is identical to all of the other rectangular skeletal frames, and each of the vertical members is identical to all of the other vertical members. Each of the vertical members has a connector portion and a track portion. The rectangular skeletal frames are adapted to be bolted to other rectangular skeletal frames in either a fixed or pivotal relationship at the connector portions of the vertical members.

Each of the rectangular skeletal frames is also adapted to be hingedly connected to the other rectangular skeletal frames. The track portions are adapted to receive a display panel within the track portions. The track portions are positioned so that the connector portions do not interfere with the track portions or display panels.

U.S. Pat. No. 4,926,609, issued to Arico, discusses a freestanding knockdown exhibit display system having a plurality of structural panels hingedly connected in side-by-side relationship by flexible hinge members to form a pair of panel sections. A recessed portion on the front surface and along the bottom peripheral edge of each structural panel of one panel section is provided for releasably engaging the rear surfaces of corresponding structural panels in the other panel section so that the engaged panels are releasably secured together by VELCRO-like material provided therebetween. The front surfaces of each structural panel, and any decorative overlays connected thereto, are substantially flush from the upper panel section to the lower panel section. A VELCRO fastening material is utilized on the flexible hinge members and in association with the recessed portion so that no tools, hardware or supporting structure is required to erect or knock down the display system.

U.S. Pat. No. 4,928,465, issued to Del Castillo Von Haaucke, presents a modular privacy screen having one or more panels and vertical consolidating or joining members mated to the panels by side openings or slots on the panels extending outwardly and downwardly and engaging upwardly and outwardly support surfaces on the consolidating or joining members.

U.S. Pat. No. 4,981,152, issued to Laurent, discloses a portable, foldable beach screen for providing privacy and protection from wind and blowing sand for a reclining individual. The screen is constructed from a single panel and is foldable into a compact and easily carried configuration. The screen may include a reflective material on one or both major surfaces and can carry advertising messages or other printing.

U.S. Pat. No. 5,007,473, issued to Evensen, shows a portable partition system having a pair of panel components which are adapted to assume either an operative or inoperative mode. First segments of the peripheral edges of the panel components are provided with a first attaching element, and second segments thereof are provided with a compatible second attaching element whereby, when the first attaching element of one panel component and the compatible second attaching element of the other panel component are pushed together, the panel components are interconnected in an operative mode and can be adjusted to any selective relative angular position. The interconnected panel components can be disconnected from one another upon a predetermined pulling force being exerted on one of the components. The disconnected components, when in operative mode, are adapted to assume a stacked face to face relation.

U.S. Pat. No. 5,054,507, issued to Sparks, presents a portable beach cache having a plurality of fabric panels and rigid support members arranged in a picture frame configuration for sheltering the user from wind and wind-blown debris, such as sand. A handle is provided to simplify carrying, and a hook and loop strap secures the portable beach cache in its storage position. The portable beach cache is compact when folded and light enough to be easily carried by hand. A second embodiment is disclosed wherein the portable beach cache has a single screen panel and a plurality of rigid vertical support members and elongate rods. The screen is attached between two of the vertical support members in the fashion of a tennis net. The vertical support members have pointed ends which are driven into the ground. The elongate rods are then attached to the vertical members to provide strength and to stretch the screen panel taut. The portable beach cache of the second embodiment can be easily stored by disassembly and placing the horizontal support members along side the vertical members and then rolling the vertical and horizontal members up inside the screen. The rigid support members of the second embodiment may be disassembled to provide storage.

U.S. Pat. No. 5,287,909, issued to King et al., discusses a freestanding privacy screen which comprises a plurality of like panels shaped to be positioned in a side-by-side relationship. Each panel includes a frame on which an inner panel can be mounted, and hollow side members or uprights. A pair of hinge rods are positioned in the hollow uprights of the frame for axial rotation therein and have a first key member positioned adjacent opposite ends thereof. Panel connectors interconnect adjacent panels in a mutually vertically aligned relationship. Each panel connector has a two-part body construction inter-connected by a removable fastener to capture associated end portions of adjacent hinge rods therebetween. The connectors have second key members that mate with the first key members on the hinge rod ends, which rotationally interconnect adjacent panels in a mutually vertically aligned relationship. Each panel connector has a two-part body construction interconnected by a removable fastener to capture associated end portions of adjacent hinge rods therebetween. The connectors have second key members that mate with the first key members on the hinge rod ends, which rotationally interconnect adjacent hinge rods, such that when the privacy screen panels are pivoted, the hinge rods retain adjacent panels in their vertically aligned relationship.

U.S. Pat. No. 5,291,700, issued to Chew, discloses an activities module which is positionable on a support surface such as the floor of a room to provide activity stations with horizontal work surfaces. The module includes an upright post member that has at least two vertical grooves. A flat panel has an opening sized to receive the post member. Each partition panel has an inner edge fitted into the groove, an outer edge, and a bottom edge that rests on the support surface. The partition panels each have a slot to receive the flat, horizontal panel, and fasteners secure the module together. A second, flat horizontal panel may similarly be mounted below the first flat panel, and a third flat, horizontal panel may provide a shelf or bench. Preferably, the first flat panel is circular, and the upright post is located centrally thereof; four partition panels are spaced around the center post to divide the module into four activity stations.

U.S. Pat. No. 5,486,391, issued to Tyner, relates to a panel for use as a space divider or for attachment to furniture. The panel has a molded polystyrene core encased in a plastic film layer which stabilizes the panel and allows the panel to be used as a tack board. A decorative outer cover is provided over the core and plastic layer to increase the aesthetic quality and versatility of the panel. Support plates are provided along the edges of the core underneath the plastic layer to increase the structural strength of the panel and to enable attachment of the panels to each other or to other furniture. Attachment rails are provided on the outside of the panel to protect the edges of the panel and enable a connector hinge to be attached to a panel for connecting them together. The panels may be used as a space divider can also have adjustment units to change the height of the space dividers and to stabilize the divider.

U.S. Pat. No. 5,544,369, issued to Roberts, relates to a portable shower system which, when disassembled, is stored in its own suitcase-like base, enclosing all of the support, curtain, and hose structures of the invention and for transport. Further, the portable shower system is expandable to a full height, fully enclosed shower stall.

U.S. Pat. No. 5,680,893, issued to Neer, presents a decorative screen cover. And U.S. Pat. No. 5,775,034, issued to Logue, discusses a folding screen environment system having two or more interacting screens that have elements such as shelves, tables, desks, lamps, lights, beds, sinks, ranges or drawers stored within the appropriate screen, when not in use, and, in most instances, suspended from the appropriate screen or screens, when in use. The screens and most of the elements interrelate when in fully set up configuration. The screens and associated elements are stabilized in the set up configuration by interacting hinges, locks, and stabilization legs. The screens are also interconnected with conduits to permit utility, electrical, water and communications connections to be available at the appropriate screen. The system provides a quickly and easily set up and stored environment for use as a work, play, privacy or sleep area. Some of the elements are designed to be free when in use.

U.S. Pat. No. 5,778,959, issued to Getschow, discloses a reusable, lightweight folding screen or partition composed of slim, shallow panels interconnected in edge-to-edge abutment by a plurality of elastic threads means. The elastic thread means are disposed within each panel and extend between adjacent panels through corresponding apertures in the contacting edge wall of neighboring panels. The elastic thread means are adapted to maintain the panels in abutment and to permit the screen to fold along its edges.

U.S. Pat. No. 5,881,789, issued to Melashenko et al., relates to a children's play structure including a frame having hinge structures that enable the structure to be arranged into a free-standing structure having a variety of adjustable positions. Interchangeable panels can be provided for removable attachment to the structure. At least one of the panels may include an article mounting sheet configured to receive articles such as drawings, photographs, and the like in one or more transparent pockets. The frame is easily assembled and is foldable into a compact structure when not in use. A hinge mount structure having two mounting posts facilitates assembly, disassembly, folding, and adjustable positioning, and affords structural stability to the free-standing play structure.

The British Patent (BR 2,199,743), granted to Rodger, shows a screen comprising a sheet of flexible fabric material folded over a rigid frame surrounding the sheet. And the British Patent (2,218,631), granted to Tierney, illustrates a folding screen display comprising two or more panel sections of uniform width connected by hinges formed from flexible bands. And finally, U.S. Design Pat. No. 333,706, issued to Hachkowski, illustrates a portable clothes changing booth.

None of the above inventions and patents, taken either singly or in combination, is seen to describe the instant invention as claimed.

SUMMARY OF THE INVENTION

The portable privacy screen, according to the invention, is designed to enable a user to quickly and easily create a zone of personal space in an otherwise crowded public area, so that cosmetics may be accurately applied, clothes comfortably put on and adjusted, and changes and improvements in appearance readily made on site. The screen is constructed from a plurality of individual, smaller panels and is foldable into a compact and easily carried configuration. The screen may also have a mirror and can carry advertising messages or other printing. And since the present invention has a knockdown construction, it can be easily taken down or assembled with a minimum of effort.

The portable screen is arranged in the general form of a triptych, preferably comprised of an upper and a lower array of panels. Each individual panel of the upper and lower arrays is preferably made of styrofoam or polymeric materials, but may, alternatively, be made of any lightweight, durable, and strong substance. An important advantage of the invention is the carrying bag, which is dimensioned to snugly contain the portable screen in disassembled form and itself is sufficiently configured to be carried over the shoulder of a user like a duffle bag.

Each array comprises at least two and preferably three panels hingedly interconnected in a side-by-side relationship. Disposed on the top, bottom, and peripheral side edges of each panel is a rigid frame, having two horizontal and two vertical support members. The hinge is preferably comprised of flexible fabric material, but may be made of any sufficiently strong and durable material which allows the panels to swing in both forward and backwards directions.

At least one of the upper peripheral edges of the panels of the lower array supports a bracket removably fastened thereon and adapted to receive and releasably engage at least one upper panel of the upper array. And so the lower array is reversibly interconnected to the upper array and is held in spaced-apart relation therefrom. At least one of the brackets further includes a generally planar structure arranged in substantially perpendicular relationship to the plane defined by the bracket and functioning as a shelf or tray for supporting cosmetics, personal items, and the like. The screen may also include at least one pouch or article storage bag comprised of a pair of opposed walls that define, between them, an interior volume and a mouth dimensioned for conveniently receiving various items such as a brush therein.

The privacy screen further comprises at least one preferably battery powered fluorescent light removably attached by hook and loop fastener to the front surface of the central upper panel and at least one mirror or other reflective surface, preferably disposed in a depression centrally located on the same panel. And finally, removable support members for hanging various articles such as clothes, shoes, and costumes are hung along the top edge of the screen.

Accordingly, it is a principal object of the invention to provide a portable privacy screen.

It is another object of the invention to provide a portable screen which may be used as a vanity for applying cosmetics and for adjusting the appearance and generally trimming or smoothing up one's clothes.

It is a further object of the invention to provide a portable screen which is easy to set up and remove.

Still another object of the invention is to provide a privacy screen which helps improve the confidence and self-esteem of the user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
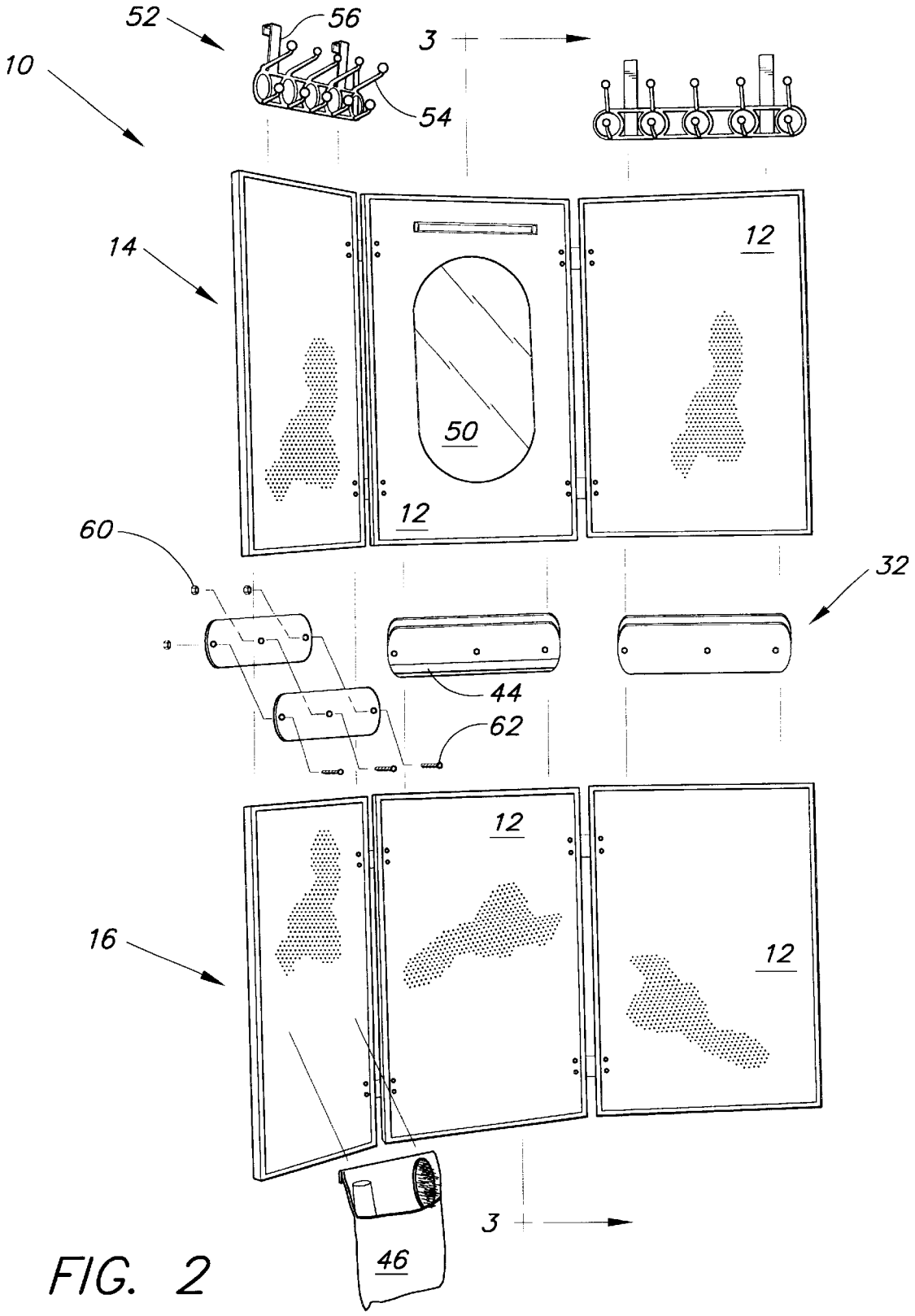
FIG. 2 is an exploded perspective view of the portable screen, according to the invention.
Figure 3:
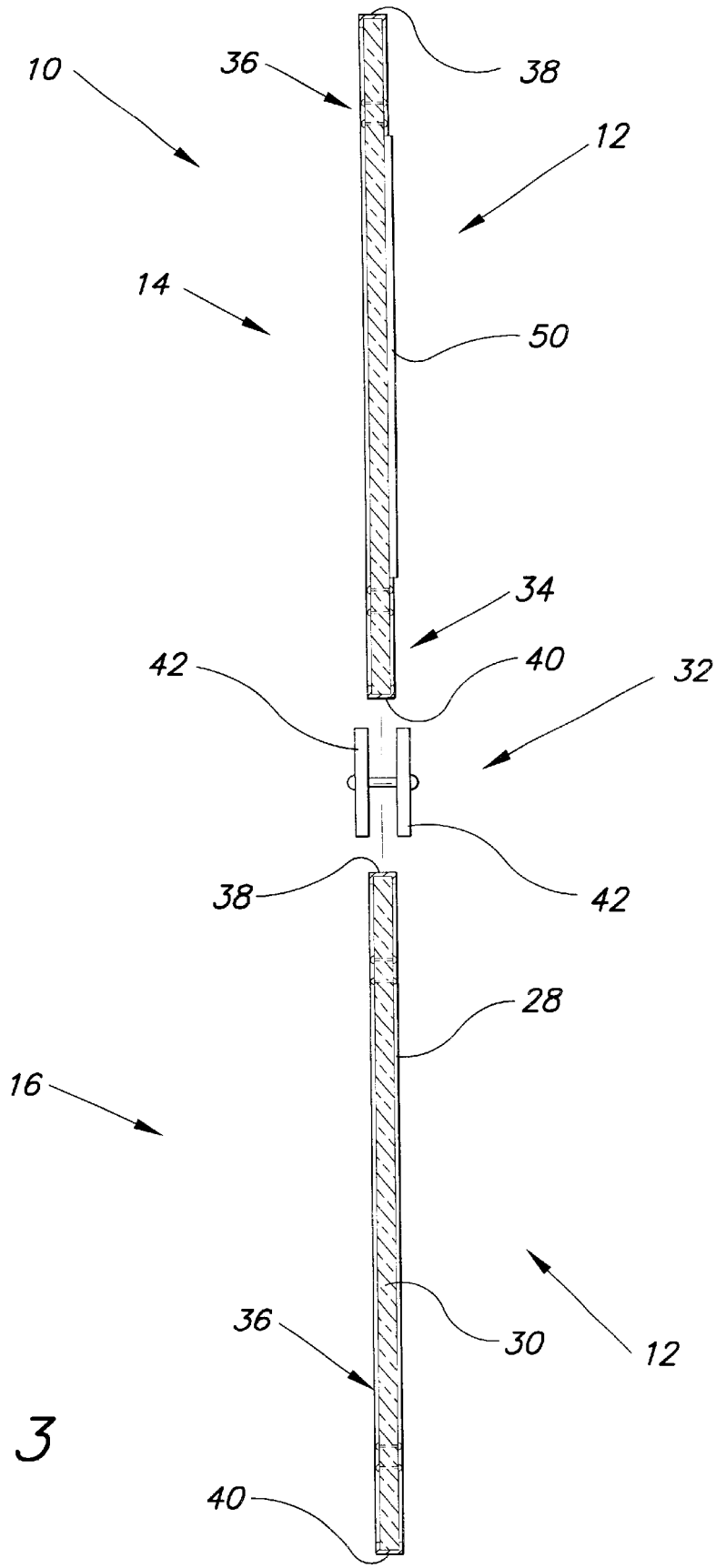
FIG. 3 is a sectional perspective view of the portable screen taken along line 3—3 of FIG. 2.

The present invention is directed to a portable privacy screen. The preferred embodiment of the invention is depicted in FIGS. 1–3, and is generally referenced by numeral 10.

Figure 1:
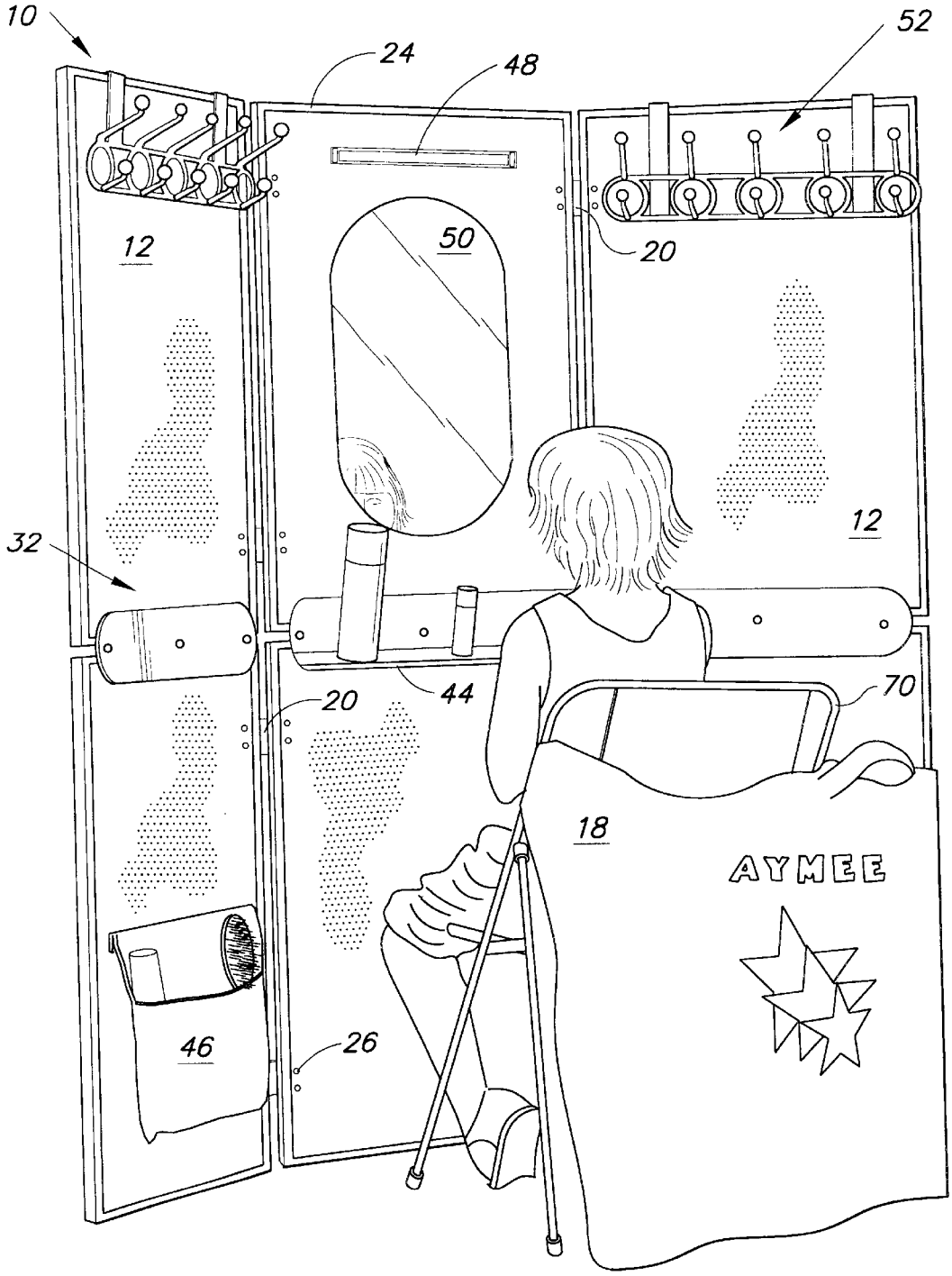
FIG. 1 is an environmental, perspective view of a portable screen according to the present invention.

As diagrammatically represented in FIG. 1, one example of a possible configuration of the portable privacy screen 10 is shown. The privacy screen 10 is designed to enable a user to quickly and easily create a zone of personal space, where makeup may be applied, clothes put on and adjusted, and last minute changes and improvements in appearance comfortably made. Hooks for hanging clothes, trays, shelves, and storage sections or pouches may also be provided. The screen 10 is constructed from a plurality of individual, smaller panels, generally 12, and is foldable into a compact and easily carried configuration. The screen 10 may also have a mirror and can carry advertising messages or other printing.

The portable screen 10 makes an important contribution to maximizing the efficient usage of space in otherwise crowded and congested areas, especially in areas which have insufficient dressing rooms or facilities for changing clothes. As sporting, recreational, and various competitive events become increasingly popular with an ever broader spectrum of people, the need for a means for insuring privacy will continue to grow.

The present invention is ideally suited for use at dance recitals and associated talent and athletic competitions because these events typically involve many children changing clothes at one time in a small area with few facilities. The present invention provides an important advantage in that it may be set up in the morning for use during the rest of day. The portable screen 10 is ideal for use at beauty pageants, theater events, and gymnastics and swimming meets.

Many individuals have experienced the awkwardness of having to dress or change their attire in public or semi-private places. One group of people which is especially vulnerable to feelings of shyness about dressing in non-private areas is pubescent age girls, such as the young girl shown in FIG. 1. Girls this age are learning how to dress and appear more fashionable in public and are some times concerned with how they are perceived by others. Childhood is an important time when people develop a sense of self, compare themselves to others, and develop self-esteem. Nevertheless, many young people feel so uncomfortable about their appearance or about being around others that they are unable to bring themselves to fully participate in sporting and recreational events, such as dancing competitions and the theater. Thus, a long felt need exists for a portable privacy screen 10, particularly one that is sufficiently durable and lightweight to be easily transported from place to place. The present invention provides a unique solution to this need in the form of a knockdown screen, which can be easily taken down and assembled with a minimum of effort.

The portable screen 10 may be taken to a competitive event in disassembled form and is designed to be either completely taken down or assembled in approximately 2 minutes. As shown in FIG. 2, in the preferred embodiment of the invention, the portable screen 10 is arranged in the general form of a triptych, preferably comprised of an upper 14 and lower 16 array of panels 12, each array, 14 and 16, also being in the general form of a triptych. Each individual panel 12 of the upper 14 and lower 16 arrays is preferably made of styrofoam or polymeric materials, but may, alternatively, be made of any lightweight, durable, and strong substance.

As seen in both FIGS. 1–2, an important accessory of the invention is the container or carrying bag 18, which is dimensioned to snugly contain the portable screen 10 in disassembled form and itself is sufficiently configured to be carried over the shoulder of a user like a duffle bag but may also include any conventional attachments such as a shoulder strap to facilitate easy carrying. The carrying bag 18 allows the user to easily decide the best location for setting up the screen 10, and to move the screen 10 if necessary. The carrying bag 18 may be a container of any kind, adapted and constructed for securely holding the screen 10 therein.

In alternative embodiments, the portable screen 10 and bag 18 can be custom made to come in a variety of sizes. And since the panels 12 and component parts of the invention are preferably made of polymeric material, the invention, including its carry bag 18, weighs no more than 15–17 pounds. Nevertheless, the invention may be comprised of heavier materials for more heavy duty use. In short, both the carry bag 18 and screen 10 may come in all sizes.

Each array, 14 and 16, comprises at least two and preferably three panels 12 hingedly interconnected in side-by-side relationship by at least one hinge, generally 20. Disposed on the top, bottom, and peripheral side edges of each panel 12 is a rigid frame 24, having two horizontal and two vertical support members. Each one of the generally rectangular panels 12 are enclosed by the vertical members and horizontal frame members. The vertical and horizontal frame members are preferably made of polymeric material but may be made of any suitably strong plastic to reduce weight and lower manufacturing costs.

The hinge 20 is preferably comprised of flexible fabric material, but may be made of any sufficiently strong and durable material which allows the panels 12 to swing in both forward and backwards directions. Nevertheless, the hinge 20 may be designed to swing in a predetermined arc or in a particular manner. Each structural panel 12 also includes at least one hinge recess arranged longitudinally along either side. A hinge faster, for example a nut and bolt assembly, generally 26, or a hook and loop fastener is provided within each hinge recess for operative engagement with the hinge 20 and respective connecting panels 12 in the lateral direction. The panels 12 are adapted to stand in a substantially vertical position, with the polystyrene bead board core configured in a preferably flat, generally rectangular shape defining the panel 12. Turning now to FIG. 3, a waterproof layer of fabric or a flexible plastic film layer 28 may be adhered to the core 30 in tension to provide an outside surface and structural strength for the core 30. An adhesive is provided between the core 30 and the plastic film layer 28 to further secure or laminate the plastic layer 28 to the core 30.

At least one of the upper peripheral edges of the panels 12 of the lower array 16 supports a bracket 32 removably fastened thereon and adapted to receive and releasably engage at least one upper panel of the upper array 14, each upper and lower panel having a front surface 34, a rear surface 36, top 38, bottom 40, and side peripheral edges (not shown). Thus, the bracket 32 serves the useful function of reversibly interconnecting the lower 16 and upper array 14 and holding them in mutual spaced-apart relation to each other. Each bracket 32 comprises a pair of generally flat elongated oval members 42, also held in parallel, spaced-apart relationship by a nut 60 and bolt 62 assembly extending therebetween, which advantageously functions to hold the respective top 38 and bottom 40 edges of adjacent panels 12 in frictional engagement therein. Thus, as indicated in the exploded view of FIG. 2, it is a simple matter to assemble the portable screen 10 on site. In alternative embodiments of the invention any interconnecting means for reversibly fastening the upper 14 and lower 16 arrays together is embraced by this specification, including connectors interconnecting adjacent panels in a mutually vertically aligned relationship.

Turning again to FIG. 2, at least one of the brackets 32 further includes a generally planar structure fastened thereon and arranged in perpendicular relationship to the plane defined by the bracket 32 to serve as a shelf 44 for supporting cosmetics and the like. In alternative embodiments of the invention, it should be understood that the screen 10 may comprise any design or structure for the shelf-like members 44, including multiple shelf members 44, cosmetic trays, and collapsible trays, which are removably fastened to a bracket 32 or reversibly attached to a panel 12 by adhesive or other fastening means. The privacy screen 10 may also include at least one pouch or article storage bag 46 comprised of a pair of opposed walls that define, between them, an interior volume and a mouth and which is removably attachable to the screen by appropriate fastening means such as an adhesive or hook and loop fastener. Articles such as a brush or toiletry item can be conveniently stored therein. The privacy screen 10 further comprises at least one preferably battery powered fluorescent light 48 removably attached by hook and loop fastener to the front surface 34 of the central upper panel. The battery powered light 48 provides an important advantage to the invention because many of the dressing areas where theatrical events and dance recitals occur are poorly lit and without electrical receptacles.

Referring again to FIG. 3, at least one of the upper panels 12 comprises a preferably ⅛ inch depressed portion adapted to receive an ovoid reflecting surface or mirror 50 adhesively disposed thereon. And although the preferred embodiment has only one mirror 50, multiple mirrors may be incorporated into the panels 12, as deemed suitable by the manufacturer. In an alternative embodiment of the invention a chair 70 or equivalent structure for sitting such as a stool may be provided; the chair 70 may also be compact or foldable for easy transport or a part of the screen 10.

The privacy screen and carry bag 18 may further comprise indicia of any kind disposed on their exterior surfaces. For example, the portable screen 10 may be individualized with indicia of a personal nature or with characters from popular culture. It should be emphasized that there is no limitation with regard to the material substrate of which the external surface of the panels 12 may be made. And so the exterior surface may be adapted for silk screening or for writing while lecturing or making a presentation. Wallpaper may be applied to the external surface of the panels 12, and the panels 12 may be specially coated, or may have material fabric, advertising labels, stencils, or photos on them.

A significant advantage of the portable screen 10 is that the screen may comprise hook structures or other support members 52 for hanging various articles such as clothes therefrom. In the preferred embodiment of the invention, the support members 52 each comprise a rack supporting a plurality of upturned rods 54 for hanging different items therefrom. Each rack 52 preferably has a pair of generally L-shaped hooks 56 for hanging the rack from the upper edge of the screen 10. However, it should be understood that the invention may include means for holding articles of any size thereon, including devices for holding smaller items such as a cork board, an article mounting sheet configured to receive articles such as drawings, photographs, and the like, or collapsible clothes hangers or hangers comprising telescoping elements.

It is to be understood that the present invention is not limited to the sole embodiments described above, but encompasses any and all embodiments within the scope of the following claims.

I claim:

1. A privacy screen comprising:

a series of lower panels hingedly interconnected in an array by at least one hinge, each one of said lower panels having a front surface, a rear surface, top, bottom, and side peripheral edges, said lower panels being adapted to stand in a substantially vertical position;

an array of upper panels, said upper panels being hingedly interconnected together by at least one hinge, each said upper panel having a front surface, a rear surface, top, bottom, and side peripheral edges; and at least one bracket, said bracket comprising a pair of flat elongated oval members interconnected in parallel spaced-apart relationship, said bracket frictionally secured on the top edge of one of said lower panels, and frictionally secured on at least one upper panel of said array of upper panels in order to support said at least one upper panel above said one of said lower panels, at least one of said brackets having a shelf extending orthogonally from one of said oval members.

2. The privacy screen of claim 1, further comprising a plurality of rigid frames disposed about the peripheral edges of each of said lower panels and each of said upper panels, each said frame having two horizontal and two vertical support members.

3. The privacy screen of claim 1, wherein said at least one upper panel hinge and said at least one lower panel hinge are comprised of flexible material.

4. The privacy screen of claim 1, wherein at least one said upper panel comprises at least one reflecting surface.

5. The privacy screen of claim 1, wherein said screen further comprises at least one second shelf for supporting items thereon.

6. The privacy screen of claim 1, wherein said screen further comprises at least one article storing pouch, said pouch including fastening means for reversibly fastening said at least one pouch to said screen.

7. The privacy screen of claim 1, wherein said screen further comprises at least one light assembly, said light assembly including fastening means for reversibly fastening said light assembly to said screen.

8. The privacy screen of claim 1, wherein said screen further comprises indicia on the outer surface thereof.

9. The privacy screen of claim 1, wherein said screen further comprises an article supporting member removably fastenable thereon.

10. The privacy screen of claim 9, wherein said article supporting member may be selected from the group consisting of a hook, a cork board, a hanger, and a rack.

11. The privacy screen of claim 9, in combination with a container for storing said screen within.

12. The privacy screen of claim 11, wherein said screen in generally triptych-shaped.

13. The privacy screen of claim 11, wherein said container and said screen have indicia disposed thereon.

14. The privacy screen of claim 1, in combination with a structure for sitting.

15. The privacy screen of claim 1, wherein said screen is generally triptych-shaped.

16. The privacy screen of claim 15, wherein said screen further comprises at least one article storing pouch and at least one article supporting member; said at least one article supporting member being selected from the group consisting of a hook, a cork board, a hanger, and a rack.

17. The privacy screen of claim 16, in combination with a container for storing said screen within.

18. The privacy screen of claim 17, wherein said screen has indicia disposed thereon.

* * * * *